US008079244B2

(12) United States Patent
Spairani et al.

(10) Patent No.: US 8,079,244 B2
(45) Date of Patent: Dec. 20, 2011

(54) DEVICE AND METHOD FOR BENDING A METALLIC STRIP

(75) Inventors: Secondo Spairani, Mortara (IT); Roberto Spairani, Mortara (IT)

(73) Assignee: Pro Form S.r.l., Caravaggio (BG) (IT)

( * ) Notice: Subject to any disclaimer, the term of this patent is extended or adjusted under 35 U.S.C. 154(b) by 630 days.

(21) Appl. No.: 12/281,316

(22) PCT Filed: Mar. 8, 2006

(86) PCT No.: PCT/IT2006/000136

§ 371 (c)(1),
(2), (4) Date: Oct. 9, 2008

(87) PCT Pub. No.: WO2007/102176

PCT Pub. Date: Sep. 13, 2007

(65) Prior Publication Data

US 2009/0188293 A1 Jul. 30, 2009

(51) Int. Cl.
*B21D 5/04* (2006.01)
*B26F 1/00* (2006.01)

(52) U.S. Cl. ..... 72/319; 72/307; 72/387

(58) Field of Classification Search ..... 72/37, 214, 72/217, 307, 317, 319, 323, 387, 388
See application file for complete search history.

(56) References Cited

U.S. PATENT DOCUMENTS

| | | | | |
|---|---|---|---|---|
| 796,335 | A | 8/1905 | Johnston | |
| 922,349 | A | 5/1909 | Sinclair | |
| 3,466,707 | A | 9/1969 | Click | |
| 4,773,284 | A | 9/1988 | Archer et al. | |
| 5,461,893 | A | 10/1995 | Tyler | |
| 5,787,750 | A | 8/1998 | Song | |
| 5,870,919 | A | 2/1999 | Song | |
| 5,881,591 | A | 3/1999 | Ondracek | |
| 6,003,358 | A | 12/1999 | Lipari | |
| 6,128,940 | A | 10/2000 | Song | |
| 6,324,882 | B1 * | 12/2001 | Kutschker et al. | 72/319 |
| 6,422,052 | B2 | 7/2002 | Park | |
| 6,427,511 | B1 * | 8/2002 | Kutschker et al. | 72/319 |
| 6,604,395 | B2 * | 8/2003 | Lee | 72/316 |
| 6,629,442 | B2 | 10/2003 | Park | |
| 7,188,504 | B2 * | 3/2007 | Latour | 72/307 |
| 7,426,846 | B2 * | 9/2008 | Urabe | 72/307 |

FOREIGN PATENT DOCUMENTS

| | | |
|---|---|---|
| EP | 0088576 | 9/1983 |
| EP | 0226167 A2 | 6/1987 |
| EP | 06994888 A1 | 3/1996 |
| GB | 2008999 | 6/1979 |
| JP | 62181835 | 8/1987 |
| JP | 08215761 A | 8/1996 |

* cited by examiner

*Primary Examiner* — David Jones
(74) *Attorney, Agent, or Firm* — Hess Patent Law Firm, PC; Robert J. Hess

(57) ABSTRACT

A device and method for bending a metallic strip (1), particularly for manufacturing die cutting blades. The bending tools (20, 30) are capable of being rotated about a common axis (15) and wherein each tool (20, 30) is further capable of being rotated about its own axis (25, 35) of rotation which is different from each others (15, 25, and 35).

14 Claims, 6 Drawing Sheets

DEVICE AND METHOD FOR BENDING A METALLIC STRIP

FIELD OF THE INVENTION

The present invention relates to a device and method for bending a metallic strip, and particularly a device and method for manufacturing die cutting blades starting from a continuous metallic strip which is shaped by means of subsequent bending steps and subjected to a final shearing step.

TECHNICAL BACKGROUND OF THE INVENTION

The metallic strip bending devices known in the art, particularly those intended for the manufacture of die cutting blades, generally comprise a system for feeding the continuous metallic strip through a guide opening, near which one or more bending tools are arranged. Most commonly, two bending tools are provided, the one for providing the strip with the right (or for example upwards) bends and the other for providing the strip with the left (or for example downwards) bends.

The strip is advanced through the guide opening and temporarily stopped when a bend has to be performed. The bending tool, which is arranged near the guide opening, is then rotated to provide the strip with the right (or left) deformation for a predetermined angle, as desired.

A double-tool bending system is described, for example, in the U.S. Pat. No. 5,870,919, in which the bending tools are engaged in suitable seats of co-axial holders that are arranged opposite the guide opening, and caused to rotate about their common axis. The bending tools can be retractable, and thus can be used in a mutually exclusive manner, i.e. a tool is held in the working position while the other is held in the rest position. Another example of a double-tool bending system is described in the U.S. Pat. No. 6,629,442 in which each tool is held by a pair of co-axial holders rotating about their common axis. The holders of a pair are arranged alternating with those of the other pair, and consequently, at least two of them are required to have an engaging seat for the bending tool being held, as well as a groove for allowing the other to move.

One of the problems involved with the known bending systems is that, during the bending step, the tool that is carrying out the bending moves away from the bending point while rotating, thereby a relative sliding movement is caused between the tool contacting the strip and the strip itself. This entails considerable wear of the bending tools, and thus the tools need to be replaced quite frequently in order to ensure the required process accuracy.

As the bending tools are very complex systems from a mechanical point of view, they may require a very long time for replacement, which may affect productivity.

In addition, it should also be noted that a tool is subjected to a stress that increases proportionally to the bending angle to be obtained. The wear effects on the tool are thus considerable, when manufacturing products with particularly sharp bending angles.

The task of the present invention is to provide a device and method for bending metallic strips, which allow to overcome the drawbacks of the prior art.

Within this task, an object of the present invention is to provide a method and device of the above-mentioned type, which allow to avoid the relative sliding motion between the bending tools and the metallic strip during the bending steps.

Another object of the present invention is to provide a method and device of the above-mentioned type which allow to hold the tool always in the most effective position, regardless of the bending angle to be obtained.

A further object of the present invention is to provide a method and device of the type mentioned above, which however allow to provide very close bends, also in the opposite directions, and also for high bending angles.

SUMMARY OF THE INVENTION

These objects are achieved according to the invention thanks to a device for bending a metallic strip, comprising at least one feeding section for carrying the strip through a guide opening, at least one pair of bending tools arranged near the guide opening, the bending tools being rotatable about at least one common axis of rotation, and means for rotatably driving the bending tools about the at least one common axis of rotation, characterized in that each of the bending tools can be rotatably driven about its own axis, which differs from the common axis of rotation and the axis of rotation of the other of the tools.

Particularly, each of the bending tools comprises rotary driving means separate from the rotary driving means of the other bending tool and from the rotary driving means of both bending tools about the common axis of rotation.

As compared with the prior art, an additional degree of freedom is thus added to the tools, thereby optimizing the position of the axis of rotation around which each tool provides the bend.

The solution proposed according to the present invention provides a number of advantages. Particularly, the tool that carries out the bend is always perpendicular to the strip to be bent, regardless of the bending angle to be obtained, thereby a considerable effectiveness is achieved in the bending step.

Another advantage is that the axis of rotation of the bending tool can always be placed in the optimum position, where the tool abutment point on the strip to be bent is maintained fixed while the bending is being carried out, contrary to what occurs with the prior art bending systems. This dramatically reduces the tool wear and allows to provide very close bends even when they have high bending angles and opposite directions (such as a 90° right bend immediately followed by a 90° left bend).

The invention further relates to a machine for manufacturing die cutting blades, as well as a bending method.

BRIEF DESCRIPTION OF THE DRAWINGS

Further characteristics and advantages of the present invention will be better understood from the following description, which is given by way of example with reference to the annexed drawings, in which.

MODES FOR CARRYING OUT THE INVENTION

Figures 1, 2, 3:
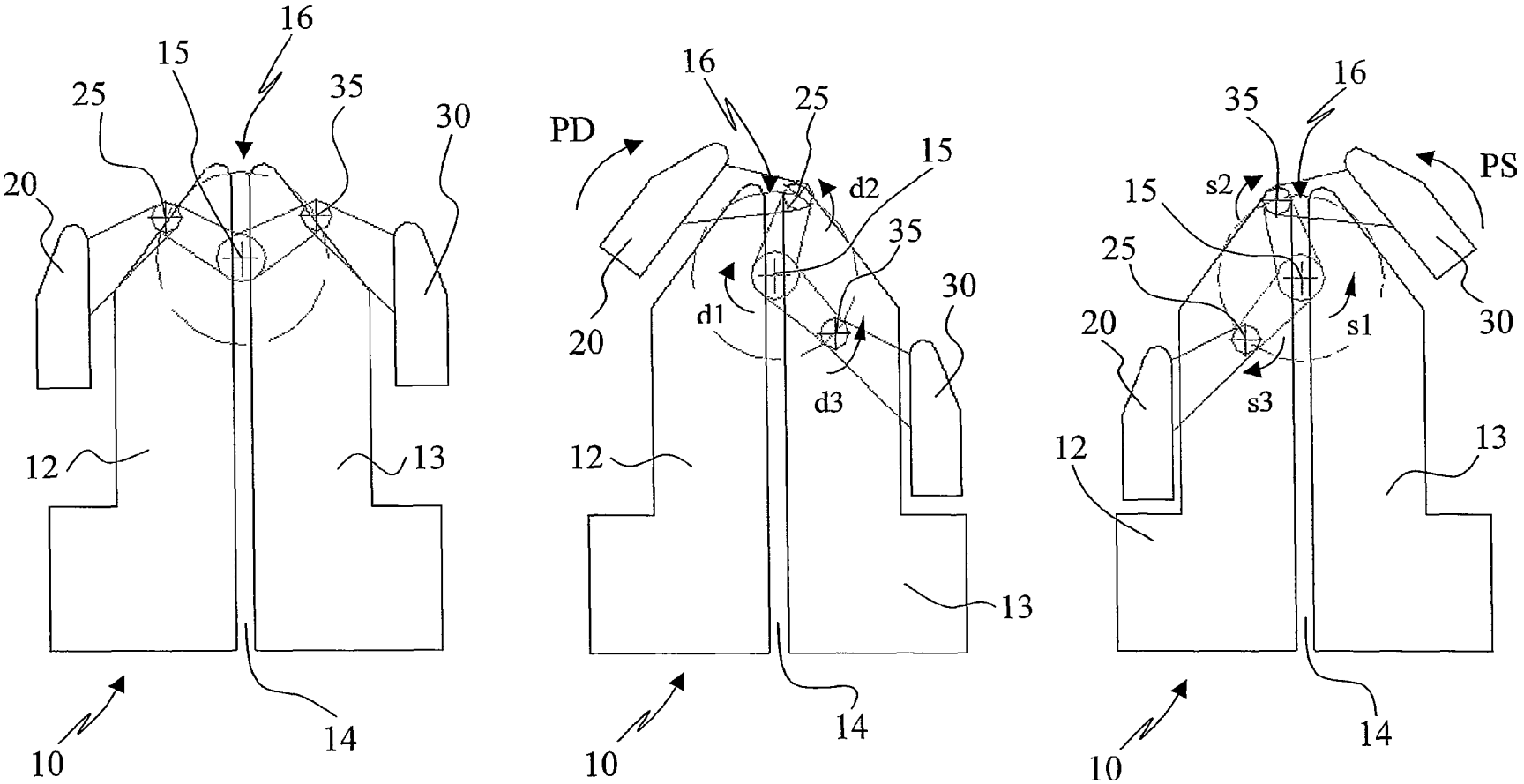
FIG. 1 is a schematic plan view illustrating several elements of a bending device according to the present invention.
FIG. 2 is a schematic plan view of the bending device as depicted in FIG. 1, with the tools positioned to carry out a right bending.
FIG. 3 is a schematic plan view of the bending device as depicted in FIG. 1, with the tools positioned to carry out a left bending.

In FIG. 1 there is illustrated a schematic and simplified version of a device for bending a metallic strip according to the present invention. The schematic view essentially reproduces a feeding section, of which a guide assembly 10, a tool 20 for carrying out the right bends on the metallic strip and a tool 30 for carrying out the left bends are represented.

The metallic strip to be bent, not shown in FIG. 1-3 for clarity, is fed through a passageway 14 comprised between the blocks 12 and 13 of the guide assembly 10, which ends with a guide opening 16.

In the representation of FIG. 1 the axes are evidenced about which the rotation of the bending tools 20 and 30 is carried out, i.e. a common axis of rotation 15, an axis of rotation 25 of the tool 20 and an axis of rotation 35 of the tool 30.

In FIG. 2, there are shown the positions of the tools for preparing a right bending of the strip. Assuming that the initial position of the tools is as shown in FIG. 1, the tools 20 and 30 are rotated clockwise about the common axis 15 (arrow d1), and simultaneously about the respective axes 25 and 35 with such rotation directions (arrows d2 and d3) that the tools move to the position illustrated in FIG. 2, i.e. the tool 30 being in the backward position and the tool 20, which is intended to carry out the right bending on the strip, having its own axis of rotation 25 passing at the end portion of the block 13. Starting from this position, the right bending is carried out by rotating only the tool 20 about its own axis 25 (arrow PD) by a certain predetermined angle in order to obtain the desired bending angle on the strip.

Accordingly, in the device according to the present invention, two types of movement can be essentially seen, i.e. a "positioning movement" of the tools which implies rotating the tools 20 and 30 about the common axis 15 and about the respective axes 25 and 35, and a "bending movement" which implies rotating the tool intended to carry out the bending only about its own axis.

On the other hand, in FIG. 3 there is shown the position of the tools for preparing a left bending of the strip. In this case, again, assuming that the initial position of the tools is as shown in FIG. 1, the tools 20 and 30 are rotated counterclockwise about the common axis 15 (arrow s1), and simultaneously about the respective axes 25 and 35 with such rotation directions (arrows s2 and s3) that the tools move to the backward position and the tool 30, which is intended to carry out the left bending of the strip, having its own axis of rotation 35 at the end portion of the block 12. Starting from this position, the left bending is carried out by rotating only the tool 30 about its own axis 35 (arrow PS) by a certain predetermined angle in order to obtain the desired bending angle on the strip.

It may be appreciated that the further degrees of freedom as determined by the rotation of the tools 20 and 30 about the respective axes 25 and 35, in addition to the common axis 15, allow bringing the tools in the most effective and advantageous condition for carrying out the bending. In other words, when the tool intended to carry out the bending, such as for instance the tool 20 (or 30) is arranged with its own axis of rotation 25 (or 35) at the end of the "opposite" block 13 (or 12), i.e. the end of the block being on the bending side, the actuated bending tool is ensured to remain always substantially perpendicular to the strip throughout the bending step.

For clarity purposes, FIGS. 4A-4D illustrate some steps of the method for left-bending a strip 1, assuming that the initial position of the tools 20 and 30 is, as depicted in FIG. 3.

Figure 4A:
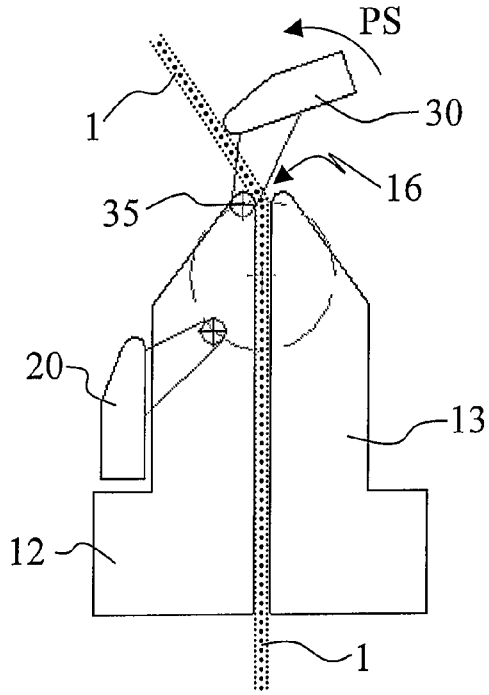
FIGS. 4A-4D schematically illustrate the left-bending steps on a metallic strip.

In FIG. 4A, the feeding of the strip 1 has been stopped and the latter is held in position between the two blocks 12 and 13. The tool 30 has already started the left-bending step on the strip 1 by carrying out a rotation in the direction indicated by the arrow PS about its own axis 35.

Figure 4B:
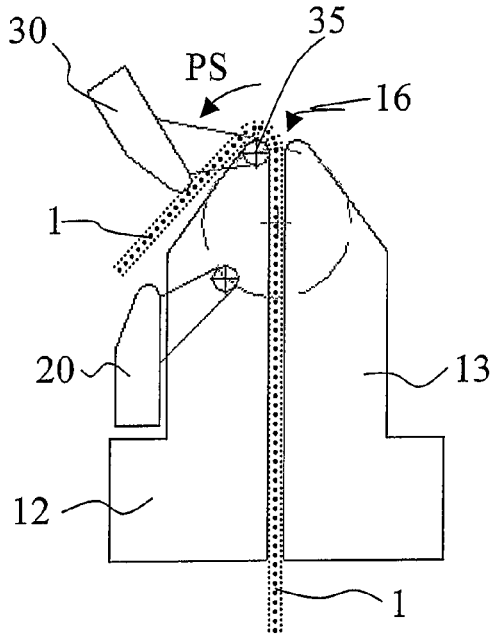
Figure 4C:
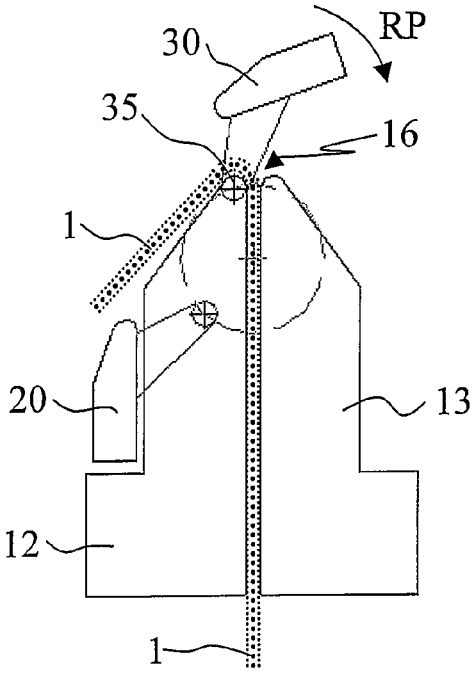
Figure 4D:
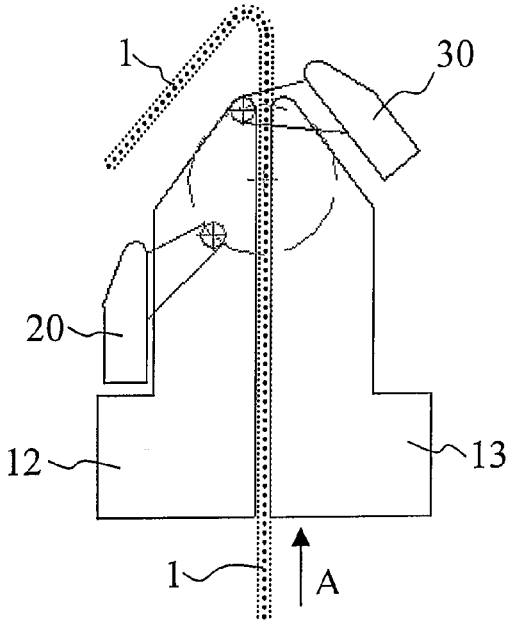

The rotation of the tool 30 continues along a predetermined arc, until the desired bend is obtained, such as illustrated in FIG. 4B. From a comparison between FIGS. 4A and 4B, it is observed that the bending tool 30 remains in contact with the strip 1 by remaining substantially perpendicular to the strip 1 throughout the bending step.

At the end of the bending step, the tool 30 is moved away from the strip 1 (FIG. 4C) and brought back to its initial position by means of a rotary movement about its own axis 35 in the direction indicated by the arrow RP. When the bending tool 30 has returned to the initial-position (FIG. 4D), the strip 1 can be advanced in the direction indicated by the arrow A. The tools 20 and 30 can be maintained in the position indicated in FIG. 4D if also the subsequent bending has to be carried out leftwards, or can be "exchanged" (FIG. 2) in the case where a right bending has to be subsequently carried out. It is understood that the same steps as represented in FIGS. 4A-4D are carried out during the right-bending of the strip 1, it should be considered however that in this case the bending tool 30 will be held in the backward position, while the bending tool 20, for example starting from the position as indicated in FIG. 2, will carry out the required bending rotations in the opposite directions with respect to the tool 30 in each step.

Figure 5:
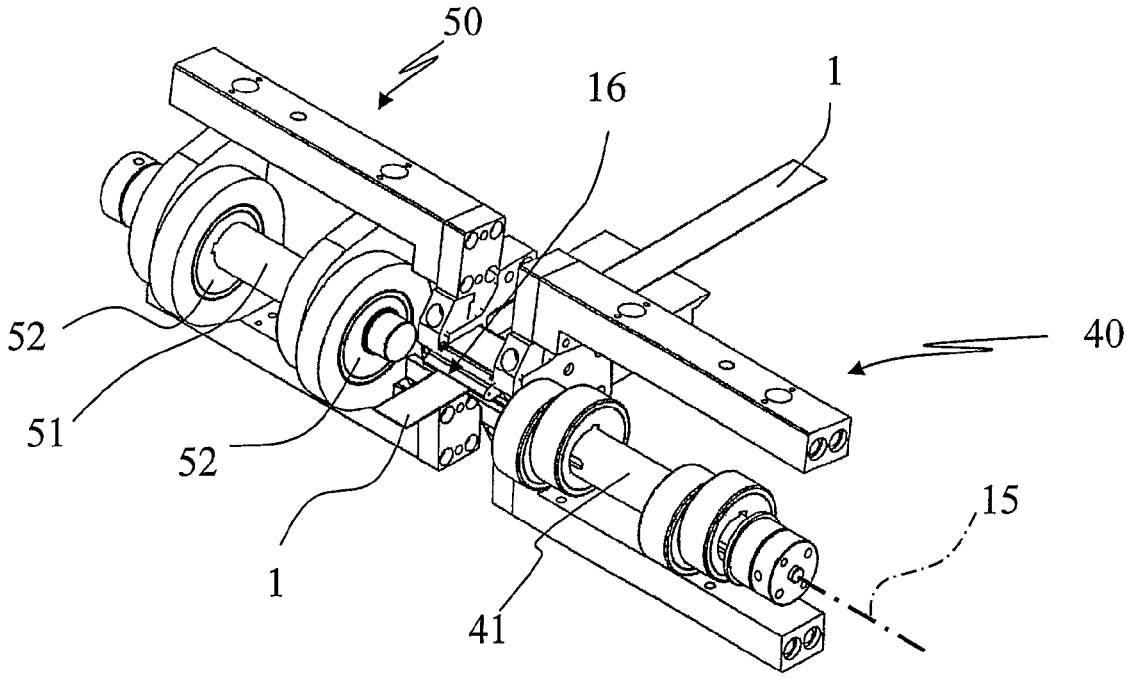
FIG. 5 is a perspective view illustrating a possible embodiment of a bending device according to the present invention, with some elements not being shown for clarity.
Figure 6:
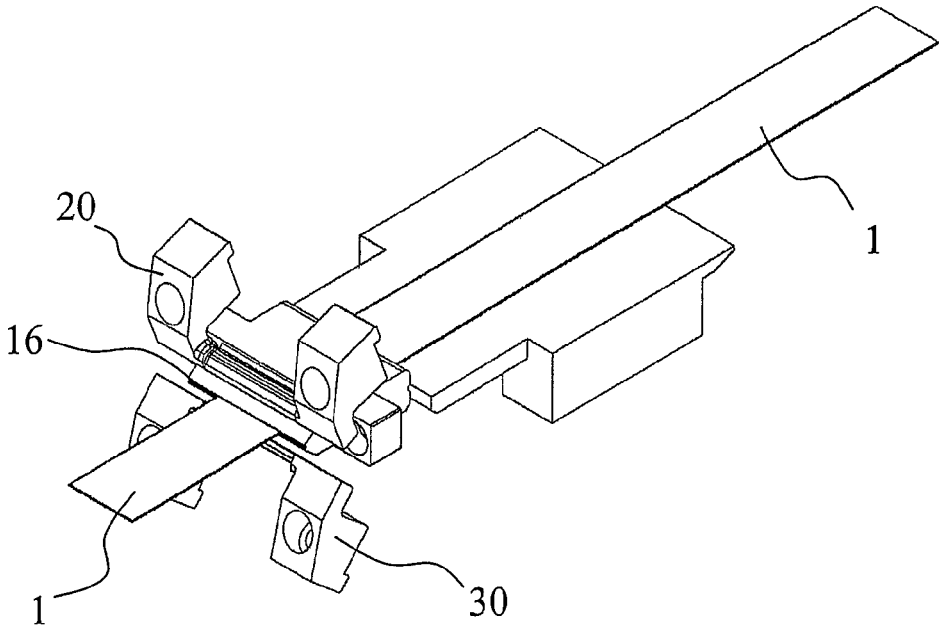
FIG. 6 is a perspective view illustrating some elements of the bending device as depicted in FIG. 5.

A possible embodiment of the present invention is represented in FIG. 5, and in the enlarged view of FIG. 6. The bending tools 20 and 30 are driven by two moving units 40 and 50, which are arranged opposite the guide opening 16 of the strip 1. The moving unit 40 in FIG. 5 is illustrated with some parts thereof being removed, in order to better highlight several constructive characteristics which will be described below in greater detail. The device has a guide opening 16 oriented in the horizontal direction, with a bending tool 20 arranged above and a bending tool 30 arranged below the guide opening 16.

Regardless of the vertical/horizontal orientation of the guide opening 16, the same considerations apply for the steps of moving the bending tools 20 and 30 as set forth above for the schematic drawings of FIGS. 1-3 and 4A-4D, but in this case it should be considered that the bends carried out by the tool 20 are directed downwards rather than rightwards, whereas the bends carried out by the tool 30 are directed upwards rather than leftwards. In any case, a device according to the present invention can be arranged with the guide opening 16 either horizontal or vertical in a machine for manufacturing die cutting blades.

Figure 7:
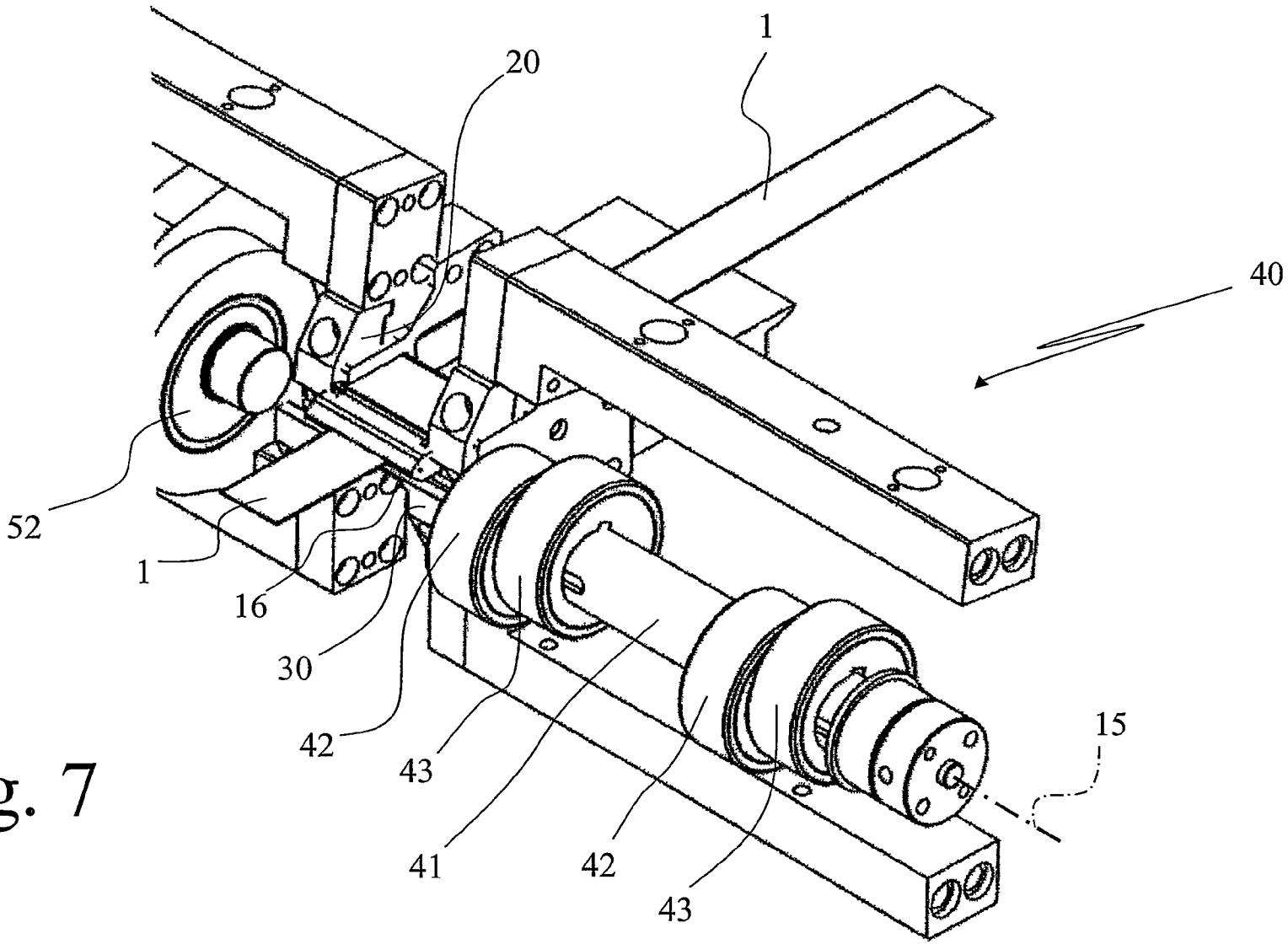
FIG. 7 illustrates an enlarged perspective view of a detail of the device from FIG. 5.

In FIG. 7, which represents an enlarged view of a part of the device as represented in FIG. 5, there is illustrated in detail the moving unit 40 comprising a main shaft 41 capable of rotating about an axis coincident with the axis of rotation 15 in common with both tools. On the shaft 41 there are provided eccentric cylindrical portions 42 and 43 with parallel and staggered axes relative to the common axis of rotation 15. The eccentric cylindrical portions 42 and 43 allow rotating the tools 20 and 30 about the respective axes of rotation 25 and 35 (not shown). An identical shaft 51 (FIG. 5) is provided in the moving unit 50 and is provided with corresponding eccentric cylindrical portions 52 and 53, of which only the eccentric portions 52 can be partially (FIG. 7) or fully (FIG. 5) seen.

Figure 8:
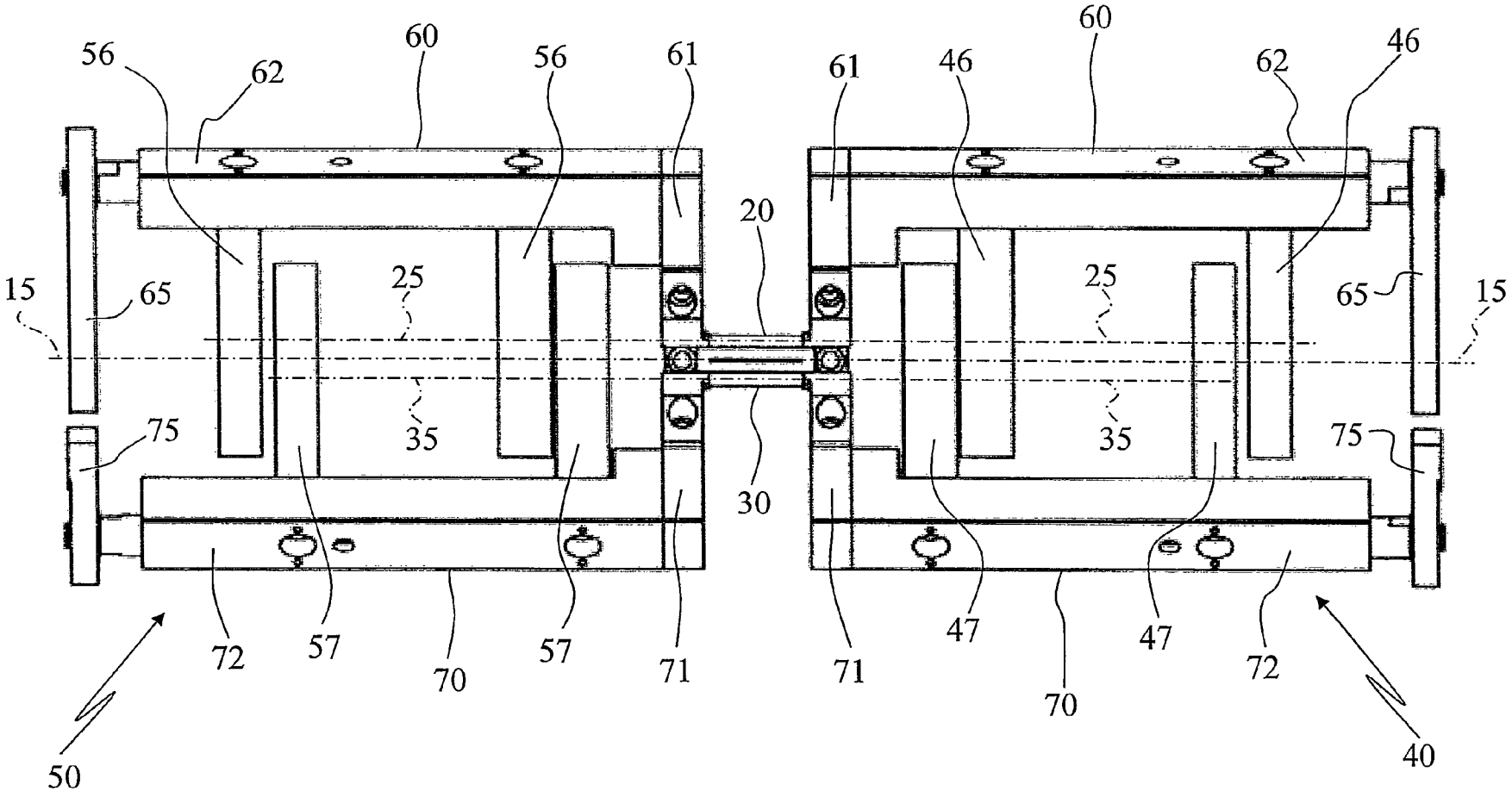
FIG. 8 is a front view of some elements composing a bending device according to the embodiment from FIG. 5.

Referring now to the view in FIG. 8, the moving units 40 and 50 comprise each an upper bracket 60 having a supporting portion 61 to which an end of the bending tool 20 is removably attached and a connecting portion 62 connecting the bracket 60 to the means for rotary driving the bending tool 20 about its own axis of rotation 25. The moving units 40 and 50 further comprise each a lower bracket 70 having a supporting portion 71 to which an end of the bending tool 30 is removably attached and a connecting portion 72 connecting the bracket 70 to the respective means for rotary driving the bending tool 30 about its own axis of rotation 35. The two moving units 40 and 50 are thus mechanically connected to each other at least via the bending tools 20 and 30.

In FIG. 8 there are further represented some connection members 46 and 56 connecting the brackets 60 of the two moving units 40 and 50 to the respective eccentric cylindrical portions 42 and 52 having the axis 25 coincident with the axis of rotation of the tool 20. In the same way, the connection members 47 and 57 connect the brackets 70 of the two moving units 40 and 50 to the respective eccentric cylindrical portions 43 and 53 having the axis 35 coincident with the axis of rotation of the tool 30.

The connection members 46 and 56 of the two moving units 40 and 50 are further rotatably mounted on the respective eccentric cylindrical portions 42 and 52, as well as the connection members 47 and 57 of the two moving units 40 and 50 are rotatably mounted on the respective eccentric cylindrical portions 43 and 53.

According to the present invention, each of the bending tools must be capable of rotating about its own axis of rotation independently from the other, and however both must be capable of rotating also about a common axis of rotation. A respective motor has to be provided for each axis of rotation, three in this case, such as an electric motor that can be controlled separately from the other two.

Figure 9:
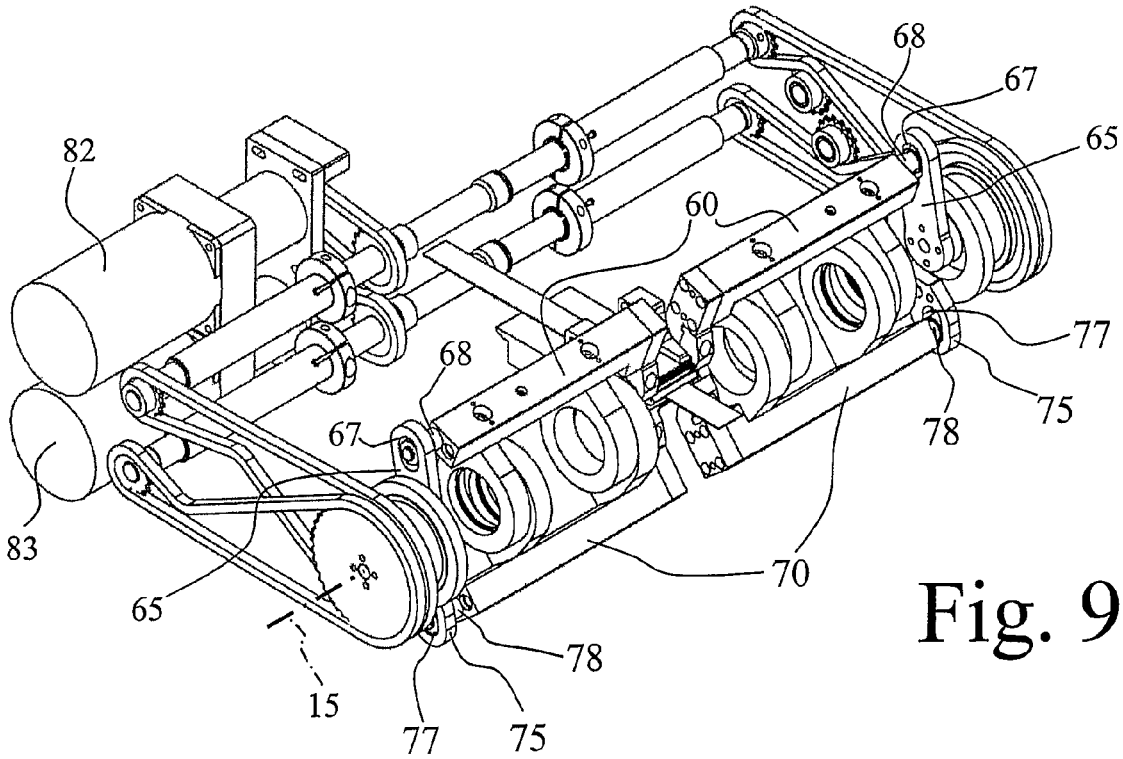
FIG. 9 is a perspective view of a bending device according to the embodiment from FIG. 5, in which the rotary driving systems of the bending tools about the respective axes thereof are evidenced.

The system for rotary driving the tools about their axes is illustrated in FIG. 9, in which a first motor 82 for rotating the tool 20 about its own axis 25 is evidenced. The motor 82 is connected to the arms 65 of both moving units 40 and 50 through rotary motion driving means that can comprise, for example, chains and geared wheels, or belts and timing belt pulleys, or gearings. The arms 65 can be rotated about the common axis of rotation 15 through respective hubs (not shown) co-axial to the main shafts 41 and 51 of each moving unit and can be separately rotated with respect to the main shafts. The free ends of the arms 65 comprise slots 67 in which respective pins 68 integral with the respective ends of the brackets 60 are slidingly engaged.

The same configuration is repeated for the rotation of the other tool 30 about its own axis 35, which is obtained by means of a second separate motor 83, which transmits the rotary motion to arms 75, which can be also rotated about the common axis of rotation 15 in a separate manner with respect to the rotation of the main shafts 41 and 51 of each moving unit. The arms 75 also have slots 77 in which pins 78 integral with the respective ends of the brackets 70 are slidingly engaged.

The rotation of the tool 20 (or 30) about its own axis 25 (or 35) is thus imparted by the arms 65 (or 75) to the brackets 60 (or 70). Thereby, the latter, by being integral with the connection members 56 (or 57), rotate about the axis of the eccentric cylindrical portions 42 (or 43), which have axes coincident with the axis of rotation 25 (or 35) of the tool 20 (or 30), thus forcing the tool 20 (or 30) to rotate about its own axis 25 (or 35).

Figure 10:
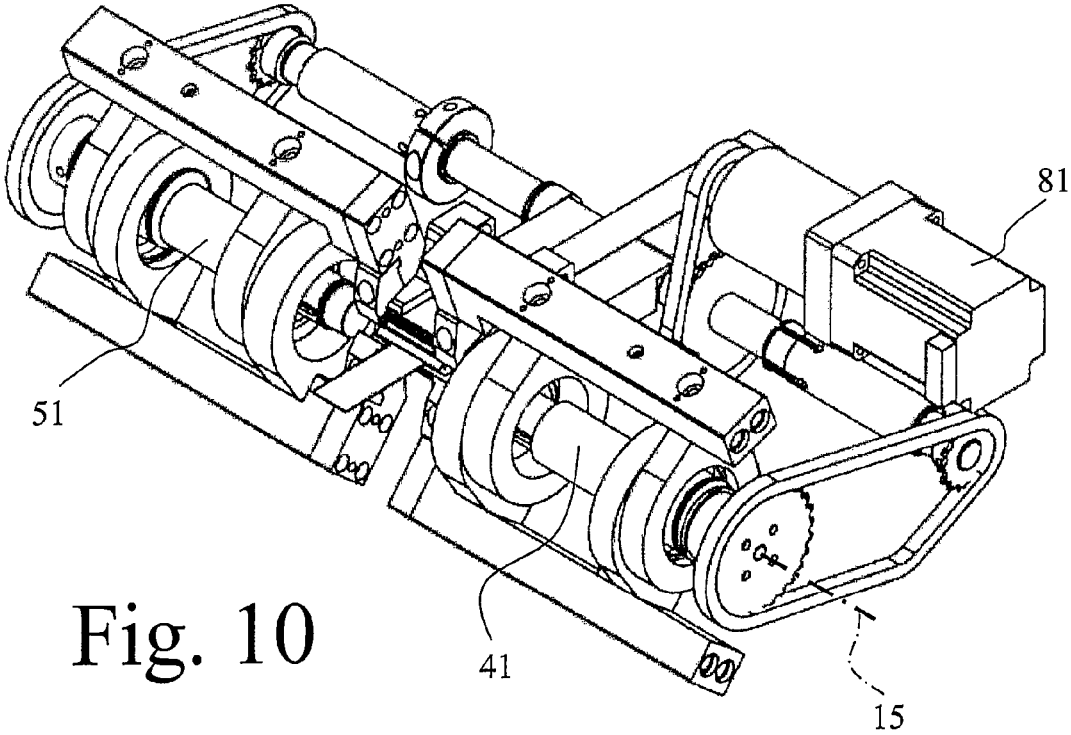
FIG. 10 is a perspective view of a bending device according to the embodiment from FIG. 5, in which the rotary driving systems of the bending tools about the respective axes thereof are evidenced.

As shown in FIG. 10, a third motor 81 has to be further provided, which can be separately controlled with respect to the other two motors 82 and 83, in order to drive the main shafts 41 and 51 rotatably about the common axis of rotation 15. Also in this case, the rotary motion driving means can comprise chains and geared wheels, or timing belt pulleys, or gearings and the like.

The invention claimed is:

1. A device for bending a metallic strip, comprising at least one feeding section for carrying said strip through a guide opening, at least one pair of bending tools arranged near said guide opening, said bending tools being rotatable about at least one common axis of rotation, and means for rotatably driving both of the bending tools about said at least one common axis of rotation, characterized in that each of said bending tools have their own axis that is different from each other and each of said bending tools is rotatably driven about said own axis, which is different from said at least one common axis of rotation.

2. The device according to claim 1, wherein each of said bending tools comprises rotary driving means independent of each other and independent of the means for rotatably driving both of the bending tools about said at least one common axis of rotation.

3. The device according to claim 1, wherein at least two moving units are provided for said tools, said moving units being arranged on opposite sides relative to said guide opening and mechanically connected to each other at least through said tools.

4. The device according to claim 3, wherein each of said at least two moving units comprise at least one main shaft having an axis of rotation coincident with said common axis of rotation, said main shaft comprising cylindrical portions having parallel and staggered axes relative to said common axis of rotation.

5. The device according to claim 4, wherein each of said moving units comprises at least one first bracket having at least one supporting portion, to which there is removably attached an end of a first of said bending tools, and at least one connecting portion having an end; and at least one connection element having an end fastened to said first bracket and another end rotatably mounted to at least a first one of said cylindrical portions with an axis that is parallel relative to the axis of rotation of said main shaft.

6. The device according to claim 5, further comprising a pin integral with the end of the at least one connecting portion of said first bracket; at least one first arm; and rotary driving means having an axis of rotation, said rotary driving means comprising at least one first motor and means for transmitting rotary motion to said at least one first arm that is rotatable about said common axis of rotation, said at least one first arm having an end through which passes said common axis of rotation and having a further end, the further end comprising a slot in which there is slidably engaged the pin integral with the end of the at least one connecting portion of said first bracket.

7. The device according to claim 6, wherein said first motor is connected to the first bracket of both said moving units.

8. The device according to claim 4, wherein each of said moving units comprises at least one second bracket having at least one supporting portion, to which there is removably attached an end of a second of said bending tools, and at least one connecting portion, and at least one connection member having an end fastened to said second bracket and another end rotatably mounted to at least a second one of said cylindrical portions with an axis that is parallel relative to the axis of rotation of said main shaft.

9. The device according to claim 8, further comprising a further pin integral with the end of the at least one connecting portion of said second bracket; at least one second arm; and rotary driving means having an axis of rotation, said rotary driving means comprising at least one second motor and means for transmitting rotary motion to said at least one second arm that is rotatable about said common axis of rotation, said at least one second arm having an end through which passes said at least one common axis of rotation and having a further end, the further end comprising a slot in which there is slidably engaged the further pin integral with the end of the at least one connecting portion of said second bracket.

10. The device according to claim 9, wherein said second motor is connected to the second bracket of both said moving units.

11. The device according to claim 4, wherein a third motor is provided for rotary driving said main shaft about said at least one common axis of rotation.

12. A method for performing the bending of a metallic strip, comprising steps of carrying the strip through a feeding section to a guide opening; and bending said strip by at least one pair of bending tools that are arranged near said guide opening; rotary driving said at least one pair of bending tools about at least one common axis of rotation, rotary driving each of said bending tools about a respective axis of rotation that are different from said at least one common axis of rotation and from each other.

13. The method according to claim 12, further comprising rotary driving each of said bending tools separately from each other and from the rotary driving of both of the bending tools about said at least one common axis of rotation.

14. The method according to claim 12, wherein said common axis of rotation and said respective axes of rotation of said tools are parallel to each other.

* * * * *